US005668729A

United States Patent [19]

Herbert

[11] Patent Number: 5,668,729

[45] Date of Patent: Sep. 16, 1997

[54] FRANKING MACHINE

[75] Inventor: Raymond John Herbert, Leigh-on-Sea, United Kingdom

[73] Assignee: Neopost Limited, Essex, United Kingdom

[21] Appl. No.: 379,968

[22] Filed: Jan. 27, 1995

[30] Foreign Application Priority Data

Jan. 31, 1994 [GB] United Kingdom ..... 9401759.7

[51] Int. Cl.[6] ..... G07B 17/02

[52] U.S. Cl. ..... 364/464.2

[58] Field of Search ..... 364/464.02, 464.03

[56] References Cited

U.S. PATENT DOCUMENTS 4,135,662 1/1979 Dlugos ..... 364/466

4,584,648 4/1986 Dlugos ..... 364/464.03 X 4,780,835 10/1988 Sievel et al. ..... 364/464.02 X 4,817,002 3/1989 Sansone et al. ..... 364/464.02 X

FOREIGN PATENT DOCUMENTS 0 019 515 11/1980 European Pat. Off. .

2 062 311 5/1981 United Kingdom .

*Primary Examiner*—Edward R. Cosimano

*Attorney, Agent, or Firm*—Shoemaker and Mattare, Ltd.

[57] ABSTRACT

A franking machine is provided with display means capable of retaining and displaying information even when power supply to the franking machine is terminated. Part of the display means may be utilised to display information to be inspected only by authorised service personnel. Accordingly that part of the display means is hidden behind a sealed door.

6 Claims, 1 Drawing Sheet

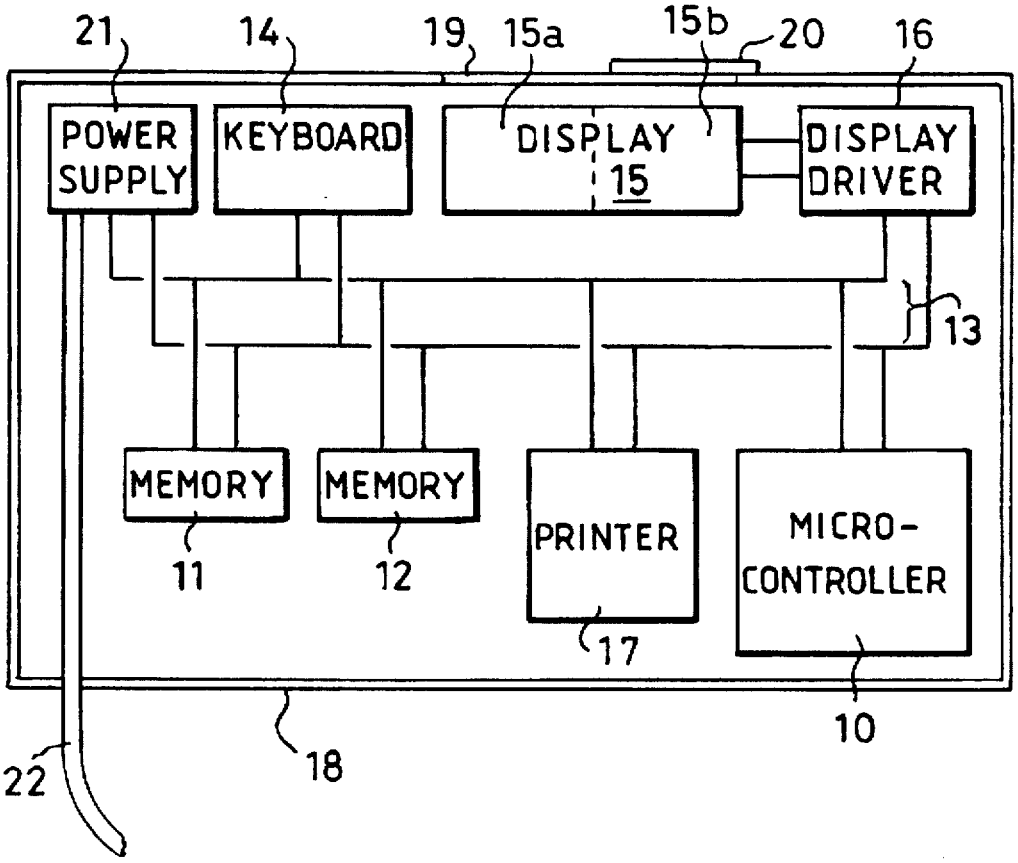
21
14
19
15a
15b
20
16
POWER SUPPLY
KEYBOARD
DISPLAY 15
DISPLAY DRIVER
13
MEMORY
MEMORY
PRINTER
MICRO-CONTROLLER
11
12
17
10
18
22

FRANKING MACHINE

BACKGROUND OF THE INVENTION

This invention relates to franking machines and in particular to the retention of data in and retrieval of data from such machines when electrical power supply to the machine is terminated or a machine failure occurs.

Known electronic franking machines include electronic circuits, usually implemented as a microprocessor, to carry out functions of controlling operation of the machine and of carrying out accounting in respect of credit with which the franking machine is charged and use of value when mail items are franked with postage charges. Memory devices store accounting data and the stored accounting data is updated in the course of carrying out each transaction in which franking of a mail item is effected or credit is entered into the machine. For this purpose, the memory devices include a number of registers for storing the accounting data. A descending register is provided to store a value of credit entered into the machine and available for use in franking operations. An ascending register stores an accumulated value of postage charges applied to mail items when franking the mail items. An items count register stores a count of the number of mail items franked and a high items register stores a count of the number of mail items franked with a postage charge greater than a predetermined value. The accounting data stored in the memory of the franking machine provides a record of usage of the franking machine in franking mail items and hence is a record of revenue to the postal authority and of expenditure on postage charges by a user of the franking machine. Accordingly it is a requirement of the postal authorities that the accounting data is accurate and may be accurately retrieved at all times even after a failure of the franking machine. In order to ensure that the integrity of the accounting data is maintained in the event of a failure or malfunction of the memory, two memory devices are provided and each register is replicated in duplicate in each memory device. Thus four replications of each register are provided. The integrity of the accounting data stored in the memory devices is checked before and after, updating of the account records in each franking operation. This is effected by the microprocessor carrying out a check to determine that the data stored in each replication of the registers is identical. If this check indicates that an error has occurred, for example the contents of one replication of a register differ from the contents of the other replications of that register, an error flag is set and the franking machine is inhibited from use for franking operations until such time as a service call has been made and the malfunction of the franking machine has been diagnosed and corrected by an engineer authorised by the postal authority.

Errors may occur in the accounting data stored due to corruption of data already stored in the memory device or due to corruption of data when the data is being written to the memory device. Also a failure in a circuit element occur during an operation cycle and result in noncompletion of an operation in which stored accounting data is being updated.

Generally, by inspection of the contents of the registers it is possible in situations in which an error has occurred to calculate or otherwise determine the correct values of the accounting data and to correct the contents of the registers as may be necessary to ensure that the true values of accounting data are stored in all the replications of all the registers. However, particularly in the event of a substantial failure of franking machine, read out the data stored in the memory devices may be possible only by use of specialised service equipment by a service engineer.

SUMMARY OF THE INVENTION

According to the invention a franking machine includes electronic means operable to carry out accounting and control functions during franking operations to frank mail items; input means for input to the electronic means of a selected value of postage charge; a printer operable by said electronic means to print franking impressions including an indication of the selected value of postage charge on mail items; and display means operable by said electronic means to display information relating to operation of the franking machine during franking operations, said display means being effective to retain an image of said information until such time as updated information is input to the display means by said electronic means.

BRIEF DESCRIPTION OF THE DRAWING

An embodiment of the invention will now be described by way of example with reference to the drawing which is block diagram of a franking machine.

DESCRIPTION OF THE PREFERRED EMBODIMENT

Referring to the drawing a microcontroller 10 is operable under program routines to carry out accounting and control functions required for operation of the franking machine to frank mail items and for operation of the franking machine to carry out other tasks such as recrediting the franking machine with a value of credit to be used franking mail items. Accounting data generated out operations in which accounting data required to be updated is stored in registers implemented in memory devices 11, 12. Communication between the microcontroller and the memory devices is effected via a bus 13 which carries address signals effective to address a selected register in the memory devices and data to be transferred from the microcontroller to the memory devices when a write operation is effected or from the memory devices to the microcontroller when a read operation is effected. The memory devices are non-volatile and may comprise memory elements inherently capable of retaining stored data when power is not supplied or may comprise volatile memory elements continually powered, the power being supplied by battery whenever the main power supply to the franking machine is terminated. A keyboard 14 is connected to the bus 13 to enable input of control signals by a user of the franking machine to cause the franking machine to initiate a selected operation. The keyboard also enables input by the user of data, for example a value of postage charge with which a mail item is to be franked. A display device 15 is provided for displaying to the user of the machine an echo of inputs on the keyboards and for displaying information to assist the user in operating the franking machine. The display device 15 is operated by the microcontroller 10 via a display device driver 16 connected to the bus 13. A printer 17 is operable by the microcontroller to print franking impressions on the mail items. The circuit elements of the franking machine are powered by electrical power from a power supply 21 via connections in the bus 13. The power supply is energised with electrical power via a power supply lead 22 from a mains power source.

The electronic circuits are housed in a secure housing 18 to prevent unauthorised access to the circuits in which access tampering with the circuits and with operation of the circuits could be attempted. It will be appreciated that the keyboard is mounted in a wall of the secure housing in such a manner that keys of the keyboard are accessible to a user of the franking machine. The display device is mounted adjacent a window 19 in the wall of the secure housing to permit viewing, by a user of the machine, of information displayed by the display device.

In known franking machines provided with a display device the display device operates only while the franking machine is supplied with electrical power and upon termination of the supply of electrical power any information displayed by the display device is not retained by the display device. However in the franking machine in accordance with the present invention the display device is constructed to retain the displayed information after termination of supply of electrical power to the display device. A suitable display device has been developed by the Liquid Crystal Institute of Ohio State University in USA and a disclosure relating thereto is contained in Electronics Times, December 1992. This display device is a liquid crystal device and uses a polymer to introduce defects in the crystal structure which stabilise the crystal state and break the structure into smaller domains. This stability of the crystal state results in the display device retaining the displayed image even after the supply of electrical power thereto has been terminated. The display uses levels of reflection rather than polarisation to produce grey-scale and hence special glass substrates are unnecessary and plastic substrates are satisfactory. Thus the liquid crystal display element has stable states and the state of the element may be changed from a first stable state to a second stable state by input of a drive signal thereto. Accordingly when display drive signals are input to the display device 15 by the display driver 16, the display device is set to a state in which it displays information represented by the display drive signals. The display device then continues to retain and display this image until such time as new display drive signals are input to the display device to reset the device to display new information. The displayed image is retained by the display device and the display device does not need electrical power input to retain the image.

By utilising a display device capable of retaining the displayed image, the display device or a part thereof may be utilised as a memory for data. Where the franking machine is provided with two memory devices 11, 12 the image retaining display device may be utilised to provide an additional level of memory or the image retaining display device may be substituted for one of the memory devices 11, 12. Any information required to be retrieved is stored in the image retaining display device 15 and is retained by the display device upon power down of the franking machine. The information in the display device is updated as a part of the routine in which the same or similar information is updated in the memory device. The data stored as an image in the display device may include register data, i.e. descending register credit value, ascending register accumulated value, items count and high items count. In addition other data such as statistical and service information may be stored as an image in the display device.

It may be desired that some or all of the information stored as an image in the display device is not accessible for viewing by anyone other than authorised personnel, for example service engineers or postal authority personnel. Accordingly the display device may be mounted such as to enable viewing of a part of the display viewed by a user and the remainder of the display may be obscured to the sight of a user. For example the part of the display which is not to be openly visible may be obscured by means of a sealed door or flap 20 which extends over that part of the display device and which may be opened or moved to a position in which that part of the display is visible only by authorised personnel. The display device may comprise a single display element 15, a part 15*a* of which is utilised to display information for viewing by a user of the machine and another part 15*b* of which is obscured, by the sealed door or flap 20, and is viewable only by authorised personnel. Alternatively separate display elements 15*a*, 15*b* may be provided respectively for displaying the user information and for retaining information to be viewed only by authorised personnel. If separate display elements 15*a*, 15*b* are provided, it will be appreciated that the display element 15*a* for viewing by a user may be a display device which is not capable of retaining the image displayed thereby.

In the event of power failure or power down, or machine failure, the information is retained by the image retaining display device and the information can be retrieved by visual inspection of the display without the need for connection of test equipment to the franking machine which otherwise would be necessary in order to read information from the memory device.

The display device may display an image of one or more successive records of the register contents so that retrieval of the accounting data up to the last operation or update of the data is always available and would enable retrieval of accounting data where failure occurs during an operation cycle and updating of the account data is incomplete.

I claim:

1. A franking machine including electronic means operable to carry out accounting and control functions during franking operations to frank mail items; input means for input to the electronic means of a selected value of postage charge; a printer operable by said electronic means to print franking impressions including an indication of the selected value of postage charge on mail items; display means operable by said electronic means to display information relating to operation of the franking machine during franking operations, said display means being effective to retain an image of said information until such time as updated information is input to the display means by said electronic means wherein said display means includes first and second liquid crystal display elements each having stable states and in which said first and second liquid crystal display elements are set selectively from a first stable state to a second stable state by input of a drive signal thereto; said first liquid crystal display element being operable to display user information and said second liquid crystal display element being operable to display machine information and including sealed means effective to obscure said machine information displayed by said second liquid crystal display element.

2. A franking machine including electronic means operable to carry out accounting and control functions during franking operations to frank mail items; input means for input to the electronic means of a selected value of postage charge; a printer operable by said electronic means to print franking impressions including an indication of the selected value of postage charge on mail items; and display means operable by said electronic means to display information relating to operation of the franking machine during franking operations, said display means being effective to retain an image of said information without energisation of said display means by an electrical source of power; wherein said display means includes first and second liquid crystal display elements each having stable states and in which said first and second liquid crystal display elements are set selectively from a first stable state to a second stable state by input of a drive signal thereto; said first liquid crystal display element being settable to display user information and said second display element being settable to display machine information; and including sealed means effective to obscure said machine information displayed by said second liquid crystal display element.

3. A franking machine including electronic means operable to carry out accounting and control functions during franking operations to frank mail items; input means for input to the electronic means of a selected value of postage charge; a printer operable by said electronic means to print franking impressions including an indication of the selected value of postage charge on mail items; and display means operable by said electronic means to display an image of information relating to operation of the franking machine, said display means being effective to retain said image of said information until input of updated information to the display means by said electronic means and including sealed means effective to obscure at least a part of said image of information displayed by said display means.

4. A franking machine as claimed in claim 3 wherein the display means is operable by the electronic means to display a first image of user information relating to operation of the franking machine by the user, said first image being visible to a user of the franking machine, and to display a second image of machine information relating to operation of the franking machine; and wherein the sealed means is effective to obscure said second image.

5. A franking machine including electronic means operable to carry out accounting and control functions during franking operations to frank mail items; input means operable to input a selected value of postage charge to the electronic means; a printer operable by said electronic means to print franking impressions including an indication of the selected value of postage charge on mail items; and display means operable by said electronic mean to display an image of information relating to operation of the franking machine, said display means being effective to retain said image of the information without energisation of said display means by an electrical source of power and including sealed means effective to obscure at least a part of said image of the information displayed by said display means.

6. A franking machine as claimed in claim 5 wherein the display means is operable by the electronic means to display a first image of user information relating to operation of the franking machine by the user, said first image being visible to a user of the franking machine, and to display a second image of machine information relating to operation of the franking machine; and wherein the sealed means is effective to obscure said second image.

* * * * *